US008245325B1

(12) United States Patent
Johnson

(10) Patent No.: US 8,245,325 B1
(45) Date of Patent: Aug. 21, 2012

(54) FLANNEL LINED UNIFORM PANTS

(76) Inventor: Lorraine Johnson, Boston, MA (US)

( * ) Notice: Subject to any disclaimer, the term of this patent is extended or adjusted under 35 U.S.C. 154(b) by 128 days.

(21) Appl. No.: 12/831,418

(22) Filed: Jul. 7, 2010

(51) Int. Cl.
*A41D 1/06* (2006.01)

(52) U.S. Cl. ..... 2/227

(58) Field of Classification Search ..... 2/227, 272, 2/338, 69, 79
See application file for complete search history.

(56) References Cited

U.S. PATENT DOCUMENTS

| | | | | |
|---|---|---|---|---|
| 1,490,470 | A * | 4/1924 | Laubach | 2/227 |
| 4,034,417 | A * | 7/1977 | Ellis | 2/81 |
| 4,586,196 | A | 5/1986 | White | |
| 5,027,438 | A | 7/1991 | Schwarze et al. | |
| 5,033,126 | A * | 7/1991 | Wruck et al. | 2/242 |
| 5,335,372 | A | 8/1994 | Wiedner et al. | |
| 5,664,256 | A | 9/1997 | Blauer et al. | |
| 2003/0009816 | A1 * | 1/2003 | Roome | 2/338 |
| 2006/0143777 | A1 * | 7/2006 | Dennis et al. | 2/114 |
| 2007/0266478 | A1 * | 11/2007 | Girod | 2/227 |

* cited by examiner

*Primary Examiner* — Katherine Moran

(57) ABSTRACT

Flannel lined uniform pants including a heavy fabric pants body having a flannel first layer along the entire inner side of the pants body and a thicker flannel second layer attached to a first layer inner edge. A zipper having a flap is disposed along an upper front seam between the leg portions. A securement member, which may be a button, releasably attaches waistband portion first and second ends. A first front pocket is accessible through the pants body front side, while a smaller second front pocket is disposed within one of the first front pockets. A first back pocket and a second back pocket are each centrally disposed on a rear side of the pants body. A sash portion alternately removably engages loops on the waistband portion and a wearer's hair. The sash portion bears medical indicia.

1 Claim, 5 Drawing Sheets

FLANNEL LINED UNIFORM PANTS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of medical uniforms are known in the prior art. However, what is needed is flannel lined uniform pants including a heavy fabric pants body, which is zippered, having a flannel first layer along the entire inner side of the pants body, and a thicker flannel second layer attached to a first layer inner edge along with a sash portion that alternately removably engages loops on the waistband portion and a wearer's hair. A first front pocket accessible through the pants body front side, a smaller second front pocket disposed within a first front pocket, and a first back pocket and a second back pocket are also provided along with a sash portion bearing medical indicia.

FIELD OF THE INVENTION

The present invention relates to medical uniforms, and more particularly, to a flannel lined uniform pants.

SUMMARY OF THE INVENTION

The general purpose of the present flannel lined uniform pants, described subsequently in greater detail, is to provide a flannel lined uniform pants which has many novel features that result in a flannel lined uniform pants which is not anticipated, rendered obvious, suggested, or even implied by prior art, either alone or in combination thereof.

To accomplish this, the present flannel lined uniform pants includes a heavy fabric pants body with a pair of elongated leg portions, each having an outer seam and an inner seam, conjoined along an upper rear seam. A parallelepiped waistband portion having a first end and a second end is continuously attached to the pants body along a top edge. The heavy fabric of the pants body may be duck cotton. A bottom seam is disposed proximal to the bottom edge of each leg portion. A zipper, having a flap disposed entirely thereover, is continuously disposed along an upper front seam. The zipper secures the leg portions together along the upper front seam. A securement member, which may be a button, releasably attaches the first end of the waistband portion to the second end of the waistband portion. The securement member is attached to the first end and operationally engages a buttonhole disposed through the second end of the waistband portion. A plurality of vertically disposed spaced apart loops is disposed along the waistband portion.

A first front pocket is disposed on the inner side proximal to each outer seam and to the top edge of the pants body and is accessible through the pants body front side. A second front pocket, having smaller dimensions than the first front pocket, is disposed within one of the first front pockets. A first pocket seam is continuously disposed proximal to a concave outside edge of each of the first front pockets. A second pocket seam is continuously disposed along a vertical edge of the second front pocket. The second front pocket may be used to carry pocket change. A first back pocket and a second back pocket, which may be square, are each centrally disposed between the upper rear seam and the outer seam.

An elongated thin parallelepiped sash portion alternately removably engages the loops on the waistband portion and a wearer's hair, thus allowing a wearer to form a ponytail or to wear the sash as a headband. The sash portion bears medical indicia representing medical symbols to advise a patient that the person attending the patient is medical personnel.

Importantly, a flannel first layer, having an outer edge and an inner edge, is continuously attached to the entire inner side of the pants body, while a thicker flannel second layer is continuously attached to the first layer inner edgeThe first layer and the second layer provide warmth and enhance comfort while being worn by a wearer. The warmth provided by the first layer and the second layer keeps medical personnel warm while working outdoors in cold weather. The first layer and the second layer maintain body warmth and eliminate the need for the wearer to don multiple layers of garments to maintain the same level of warmth as provided by the present flannel lined uniform pants, but without the bulk associated with multiple garments, including thermal underwear. The softness of the flannel further provides comfort against the skin of the wearer.

The medical indicia on the sash portion may be replaced by symbols associated with various sports, such as golf, nautical symbols, and other decorative symbols. The present flannel lined uniform pants may be formed in a wide array of colors, sizes, and styles for men, women, and children.

Thus has been broadly outlined the more important features of the present flannel lined uniform pants so that the detailed description thereof that follows may be better understood and in order that the present contribution to the art may be better appreciated.

Numerous objects, features and advantages of the present flannel lined uniform pants will be readily apparent to those of ordinary skill in the art upon reading the following detailed description of presently preferred, but nonetheless illustrative, examples of the present flannel lined uniform pants when taken in conjunction with the accompanying drawings. In this respect, before explaining the current examples of the present flannel lined uniform pants in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the flannel lined uniform pants. It is therefore important that the claims be regarded as including such equivalent constructions insofar as they do not depart from the spirit and scope of the present invention.

Objects of the present flannel lined uniform pants, along with various novel features that characterize the invention are particularly pointed out in the claims forming a part of this disclosure. For better understanding of the flannel lined uniform pants, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
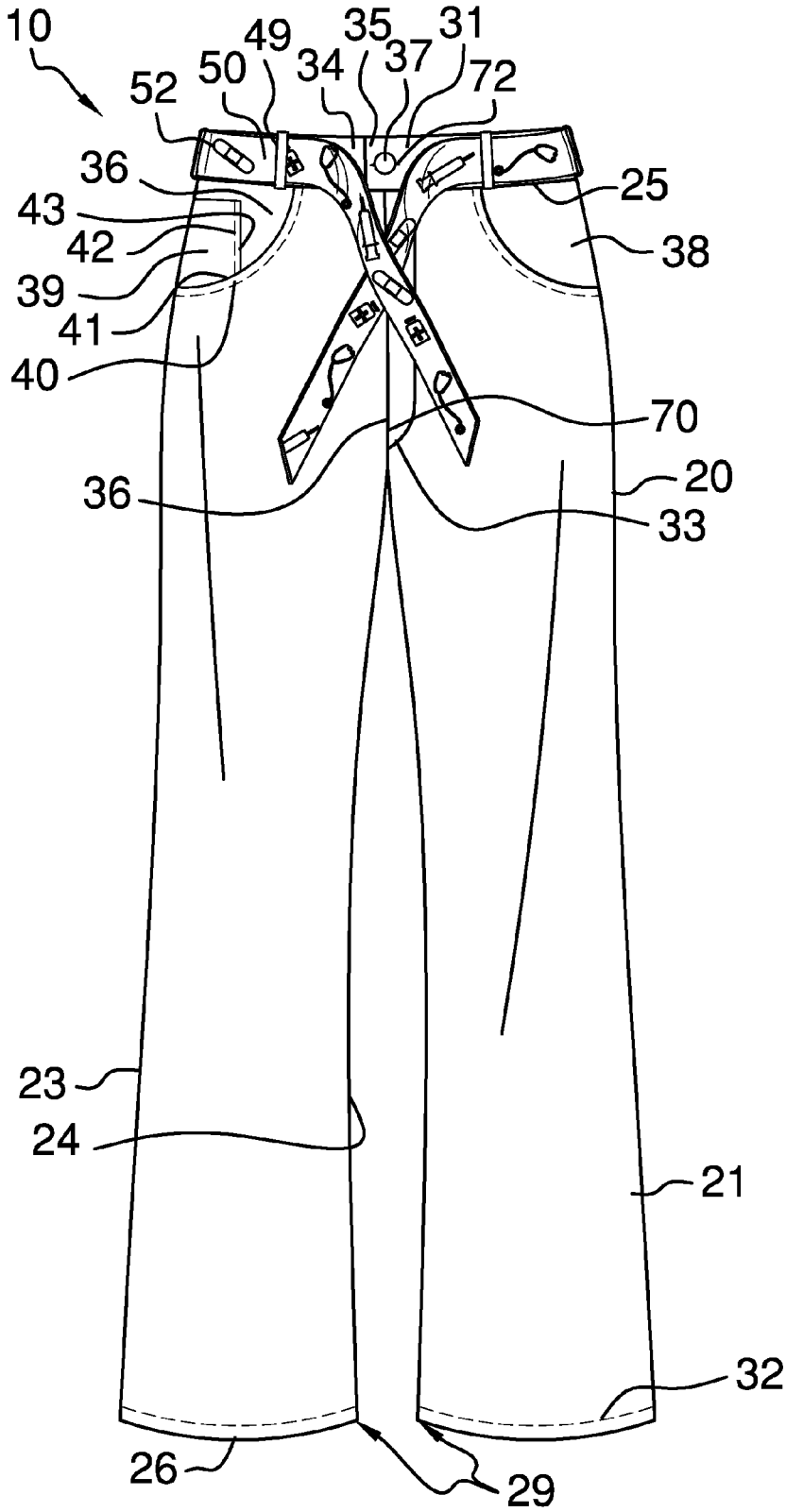
FIG. 1 is a front elevation view.
Figure 2:
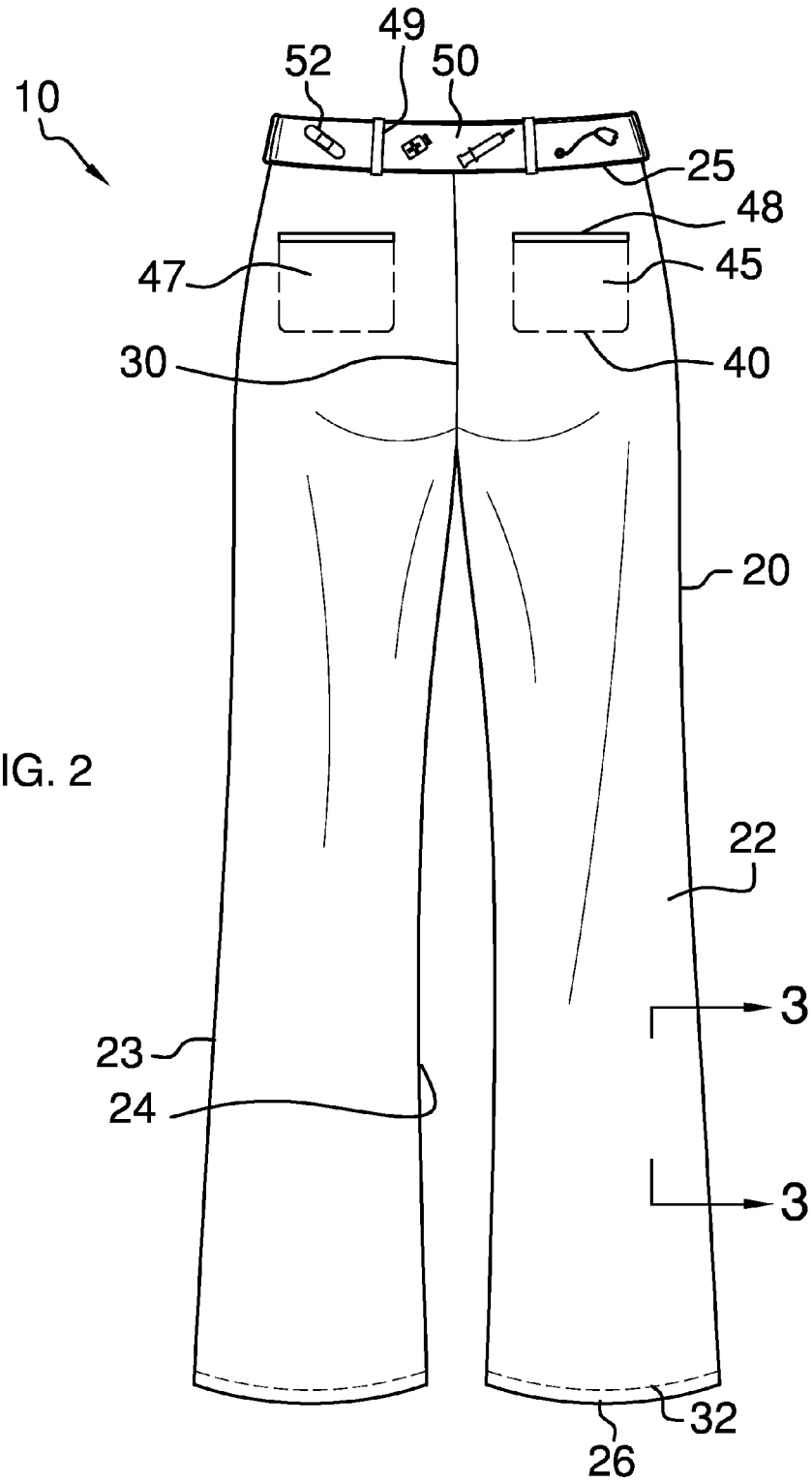
FIG. 2 is a rear view.
Figure 3:
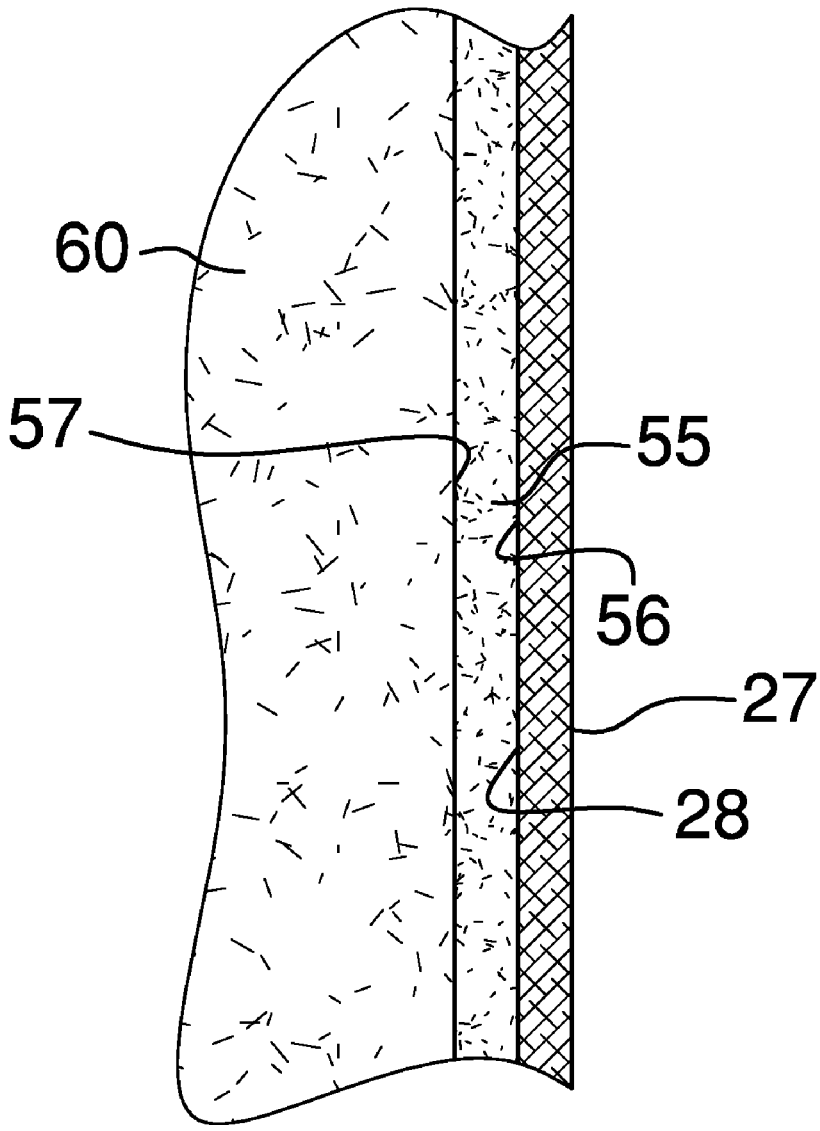
FIG. 3 is a cross-section view taken along line 3-3 of FIG. 2.
Figure 4:
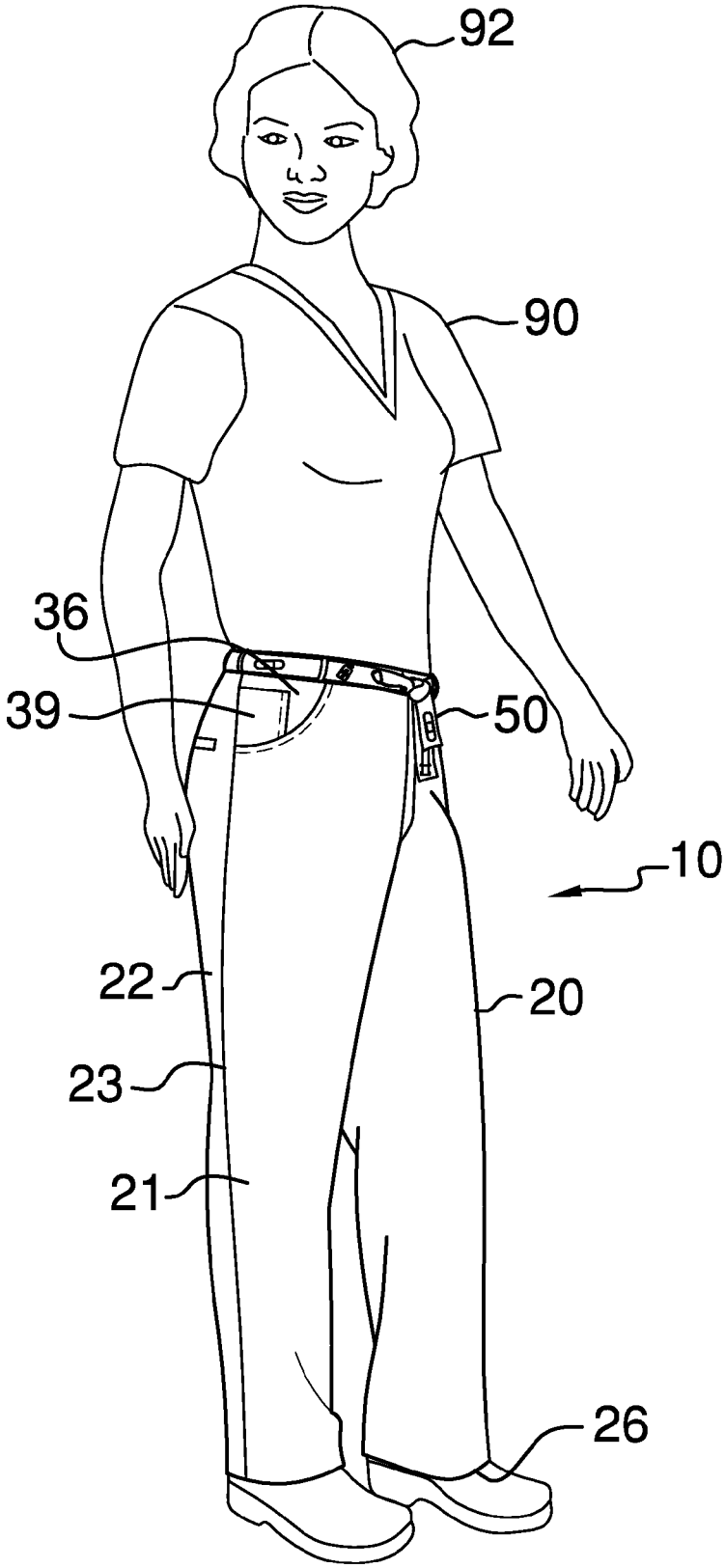
FIG. 4 is an in-use front isometric view.
Figure 5:
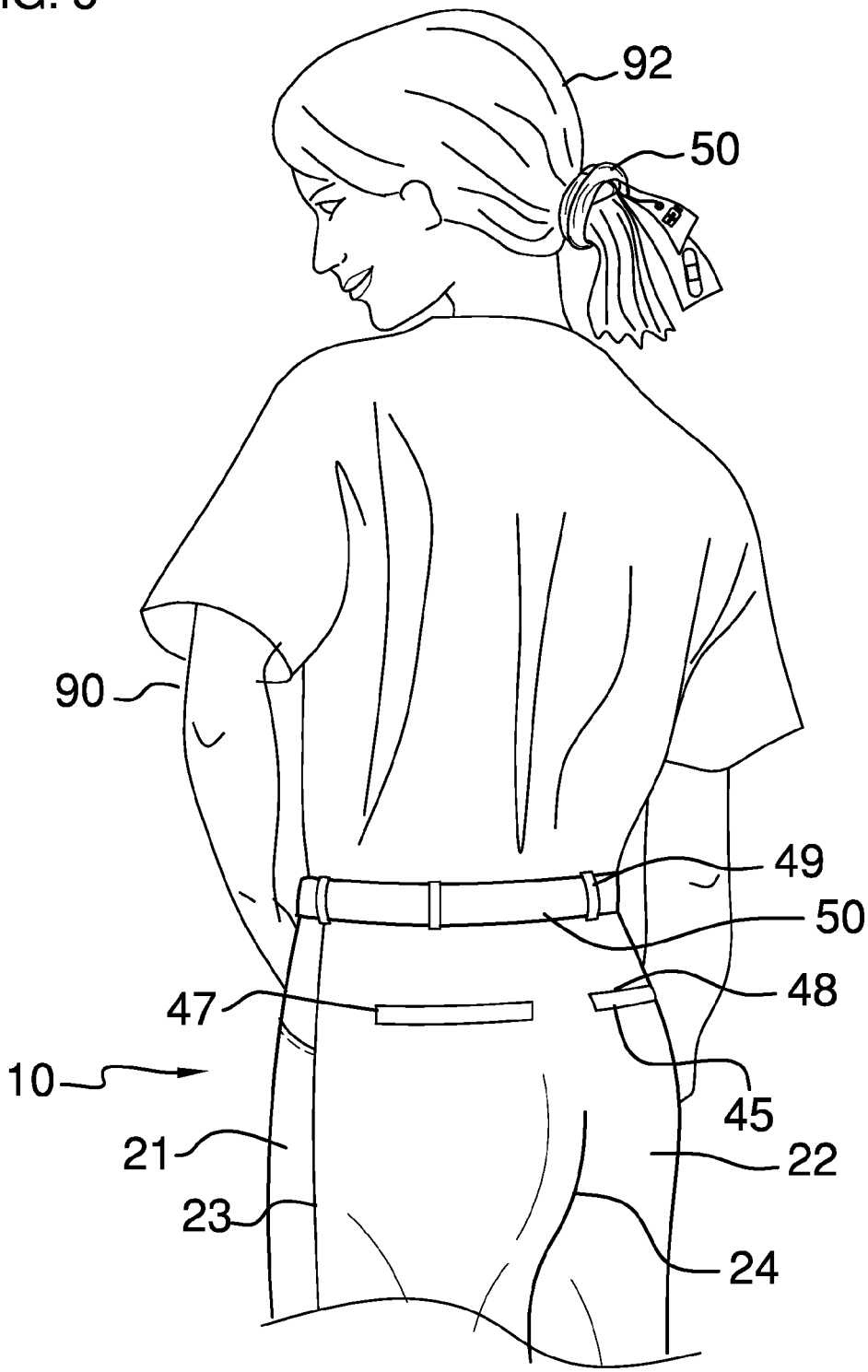
FIG. 5 is an in-use rear isometric view.

With reference now to the drawings, and in particular FIGS. 1 through 5 thereof, example of the instant flannel lined uniform pants employing the principles and concepts of the present flannel lined uniform pants and generally designated by the reference number 10 will be described.

Referring to FIGS. 1 through 5 a preferred embodiment of the present flannel lined uniform pants 10 is illustrated. The flannel lined uniform pants 10 includes a heavy fabric pants body 20 having a front side 21, a rear side 22, a top edge 25, a bottom edge 26, an outer side 27, and an inner side 28. The pants 10 also include a pair of elongated leg portions 28 conjoined along an upper rear seam 30. Each leg portion 28 has an outer seam 23 and an inner seam 24. A parallelepiped waistband portion 31 is continuously attached to the pants body 31 along the top edge 25. The waistband portion 31 has a first end 34 and an opposite second end 35. The heavy fabric of the pants body 20 may be duck cotton.

A bottom seam 32 is disposed proximal to the bottom edge 26 of each leg portion 29. A zipper 33, having a flap 70 disposed entirely thereover, is continuously disposed along an upper front seam 36. The zipper secures the leg portions 29 together along the upper front seam 36. A securement member 37, which may be a button, releasably attaches the first end 34 of the waistband portion 31 to the second end 35 of the waistband portion 31. The securement member 37 is attached to the first end 34 and operationally engages a buttonhole 72 disposed through the second end 35 of the waistband portion 31. A plurality of vertically disposed spaced apart loops 49 is disposed along the waistband portion 31.

A first front pocket 38 is disposed on the inner side 28 proximal to each outer seam 23 and to the top edge 25 of the pants body. Each first front pocket 38 is accessible through the front side 21 of the pants body 20. A second front pocket 39 is disposed within one of the first front pockets 38. The second front pocket 39 has smaller dimensions that the first front pocket 38. A first pocket seam 40 is continuously disposed proximal to a concave outside edge 41 of each of the first front pockets 38. A second pocket seam 42 is continuously disposed along a vertical edge 43 of the second front pocket 39. The second front pocket 39 may be used to carry pocket change.

A first back pocket 45 and a second back pocket 47, which may be square, are each centrally disposed between the upper rear seam 30 and the outer seam 23. Each of the first back pocket 45 and the second back pocket 47 have an upper opening 48 providing access to each of the first back pocket 45 and the second back pocket 47, respectively.

The present pair of flannel lined uniform pants 10 also includes an elongated thin parallelepiped sash portion 50. The sash portion 50 alternately removably engages the loops 49 on the waistband portion 31 and a wearer's 90 hair 92. The sash portion 50 bears medical indicia 52 representing medical symbols such as a bandage, pill bottle, injection needle, stethoscope, and the like, to advise a patient that the person attending the patient is medical personnel.

Importantly, a flannel first layer 55 is continuously attached to the entire inner side 28 of the pants body 20. The first layer 55 has a continuous outer edge 56 and an opposite continuous inner edge 57. A flannel second layer 60 is continuously attached to the inner edge 57 of the first layer 55. The second layer 60 is thicker than the first layer 55. The first layer 55 and the second layer 60 provide warmth and enhance comfort while being worn by a wearer 90. The warmth provided by the first layer 55 and the second layer 60 keep medical personnel warm while working outdoors in cold weather. The first layer 55 and the second layer 60 maintain body warmth and eliminate the need for the wearer 90 to don multiple layers of garments to maintain the same level of warmth as provided by the present flannel lined uniform pants 10, but without the bulk associated with multiple garments, including thermal underwear. The softness of the flannel further provides comfort against the skin of the wearer 90.

With respect to the above description then, it is to be realized that the optimum dimensional relationships for the parts of the present flannel lined uniform pants to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A pair of flannel lined uniform pants consisting of:

a heavy fabric pants body consisting of:

a front side;

a rear side;

a top edge;

a bottom edge an outer side;

an inner side;

a pair of elongated leg portions conjoined along an upper rear seam, each leg portion having an outer seam and a inner seam;

a waist portion continuously attached to the pants body along the top edge, the waist portion having a first end and an opposite second end;

a bottom seam proximal to the bottom edge of each leg portion;

a zipper having a flap disposed continuously disposed thereover, the zipper disposed along an upper front seam, wherein the zipper secures the leg portions together along the upper front seam;

a securement member, wherein the securement member releasably attaches the first end to the second end of the waist portion;

a first front pocket disposed on the inner side proximal to each outer seam and to the top edge of the pants body; each first front pocket accessible through the front side of the pants body;

a second front pocket disposed within one of the first front pockets, the second front pocket having smaller dimensions that the first front pocket;

a first pocket seam continuously disposed proximal to a concave outside edge of each of the first front pockets;

a second pocket seam continuously disposed along a vertical edge of the second front pocket;

a first back pocket and a second back pocket each centrally disposed between the upper rear seam and the outer seam, each of the first back pocket and the second back pocket having an upper opening, wherein each upper opening is access to each of the first back pocket and the second back pocket, respectively;

a plurality of vertically disposed spaced apart loops disposed along the waist band portion;

an elongated thin parallelepiped sash portion wherein the sash portion alternately removably engages the loops and a person's hair;

a flannel first layer continuously attached to the inner side of the pants body, the first layer having a continuous outer edge and an opposite continuous inner edge;

a flannel second layer continuously attached to the inner edge of the first layer;

wherein the second layer is thicker than the first layer;

wherein the securement member is a button attached to the first end, the button operationally engaging a buttonhole disposed through the second end;

wherein the sash bears medical indicia.

* * * * *